United States Patent [19]

Gaskell et al.

[11] 4,057,818

[45] Nov. 8, 1977

[54] AUTOMATIC REPLENISHER SYSTEM FOR A PHOTOGRAPHIC PROCESSOR

[75] Inventors: Alfred J. Gaskell, Hopkins, Minn.; Ralph L. Charnley, Minneapolis, Minn.

[73] Assignee: Pako Corporation, Minneapolis, Minn.

[21] Appl. No.: 590,078

[22] Filed: June 25, 1975

[51] Int. Cl.[2] ..... G03D 13/00

[52] U.S. Cl. ..... 354/298; 137/93; 250/559; 250/578; 354/324

[58] Field of Search ..... 137/93; 354/297, 298, 354/324; 250/559, 578

[56] References Cited

U.S. PATENT DOCUMENTS

| | | | |
|---|---|---|---|
| 3,528,040 | 9/1970 | Galvin | 250/578 X |
| 3,529,529 | 9/1970 | Schumacher | 354/297 X |
| 3,554,109 | 1/1971 | Street et al. | 354/298 |
| 3,559,555 | 2/1971 | Street | 354/298 |
| 3,561,344 | 2/1971 | Frutiger et al. | 354/298 |
| 3,752,052 | 8/1973 | Hope et al. | 354/297 X |
| 3,822,723 | 7/1974 | Crowell et al. | 354/297 X |
| 3,927,417 | 12/1975 | Kinoshita et al. | 354/298 |

*Primary Examiner*—Fred L. Braun

[57] ABSTRACT

An automatic replenishing system for maintaining the chemical concentration of the liquid in a film processing tank, which automatically energizes a replenishing pump at regular timed intervals (e.g. every 30 seconds) regardless of whether or not the control circuitry indicates a need for replenishment, and which includes an element for sensing the density and velocity of the film and for producing a combined signal which controls the running time of the pump after each energization. The replenishing system also includes a second replenishing pump for maintaining the condition of the liquid in the processing tank, which second pump is energized automatically after a predetermined number of said regular timed intervals, or after a predetermined number of said regular timed intervals in which a zero film density or non-use condition has been detected for a preset running time.

11 Claims, 7 Drawing Figures

AUTOMATIC REPLENISHER SYSTEM FOR A PHOTOGRAPHIC PROCESSOR

BACKGROUND OF THE INVENTION

This invention relates to a method and apparatus for replenishing the processing liquid in an automatic film processor to compensate for the lowered chemical activity of the processor liquid which results from the processing of film.

It has been recognized in the prior art that a preferred way to control the rate and amount of replenishment supplied to the processor is to sense the image density of the film passing through the film processor and to drive an electrical control signal proportional to said image density which controls the replenishment means for said film processor.

The prior art replenishing systems fail to energize the replenishing pumps unless the density measuring signal indicates a need for replenishing liquid. Thus if the machine is inoperative for long periods of time (with no film passing through) and the processing liquid in the tank becomes ineffective due to oxidation, there would be no replenishment of the liquid with such equipment. These prior art systems require a certain minimum quantity of film to pass through processors before actuation of the replenishing pumps so that if a substantial quantity of film has passed through (but less than the minimum quantity required to energize the replenishing pump) and then the processor is not used for a period of time, the condition of the processor liquid deteriorates at an exponential-like rate so that it requires more replenishing liquid than can be supplied by the next cycle. This causes improper processing until sufficient replenishing liquid is supplied to bring the condition of the liquid back up to standard. This would necessitate manual assistance to prevent an unacceptable batch of film from being processed.

With the instant invention however, the replenishing pump is automatically energized at predetermined time intervals (e.g. every 30 seconds) regardless of the film density, and if the density measuring system fails to call for replenishing liquid as in the case of non-use or zero density the pump will be automatically shut off almost immediately (e.g. 20 milliseconds). By inserting a counter to count the number of non-use or zero density pump starts, an automatic replenishment cycle can be readily provided to run a second pump for a preset time after a predetermined number of such non-use or zero density start-stop cycles or after a predetermined number of cycles regardless of the density or use of the film and processor, respectively.

This invention relates to an improvement for this type of replenishment technique. It is an object of this invention to provide a method and means for replenishing the processing liquids of a film processor which is based on both the sensed image density of the film and the velocity of the film through said film processor.

It is a more particular object of this invention to provide replenishment means to maintain the chemical activity of the developing and fixing chemicals in the film processor when there is no film passing through the film processor or when said film processor is not being used.

These and other objects and advantages of this invention will be apparent from the following description made in connection with the accompanying drawing wherein like reference characters refer to similar parts throughout the several views, and in which.

DESCRIPTION OF THE PREFERRED EMBODIMENTS

Figure 1:
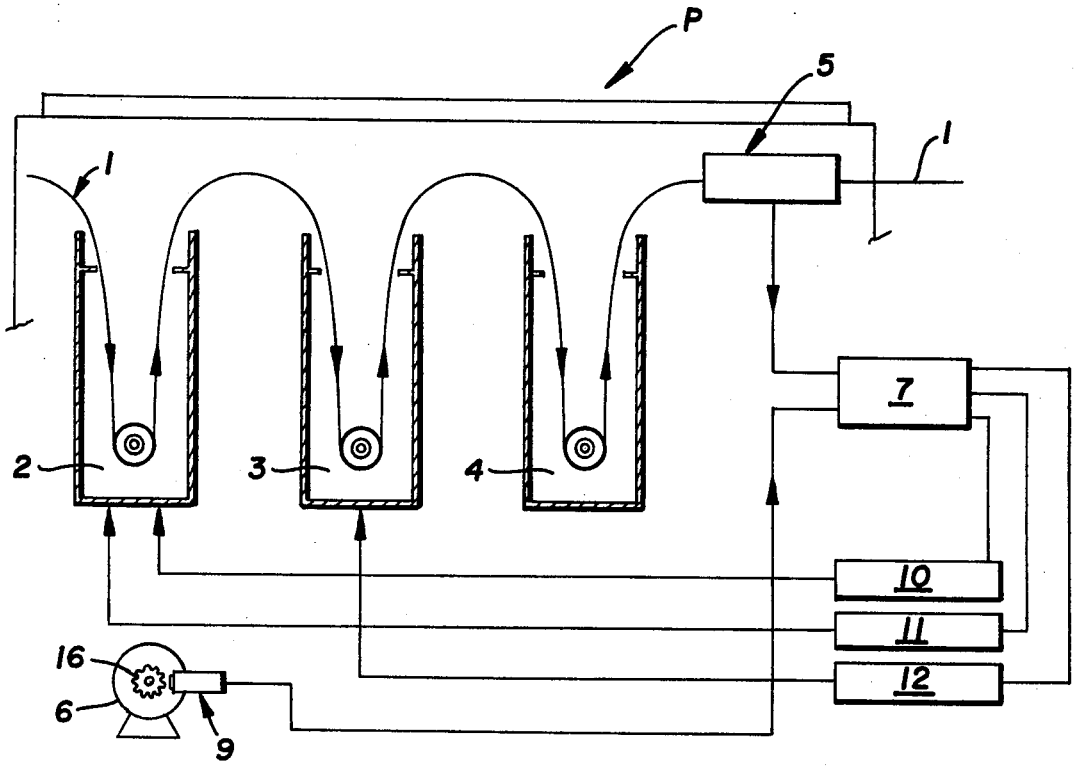
FIG. 1 is a diagrammatic side elevational view of an automatic film processor incorporating the automatic replenisher system of the present invention.
Figure 4:
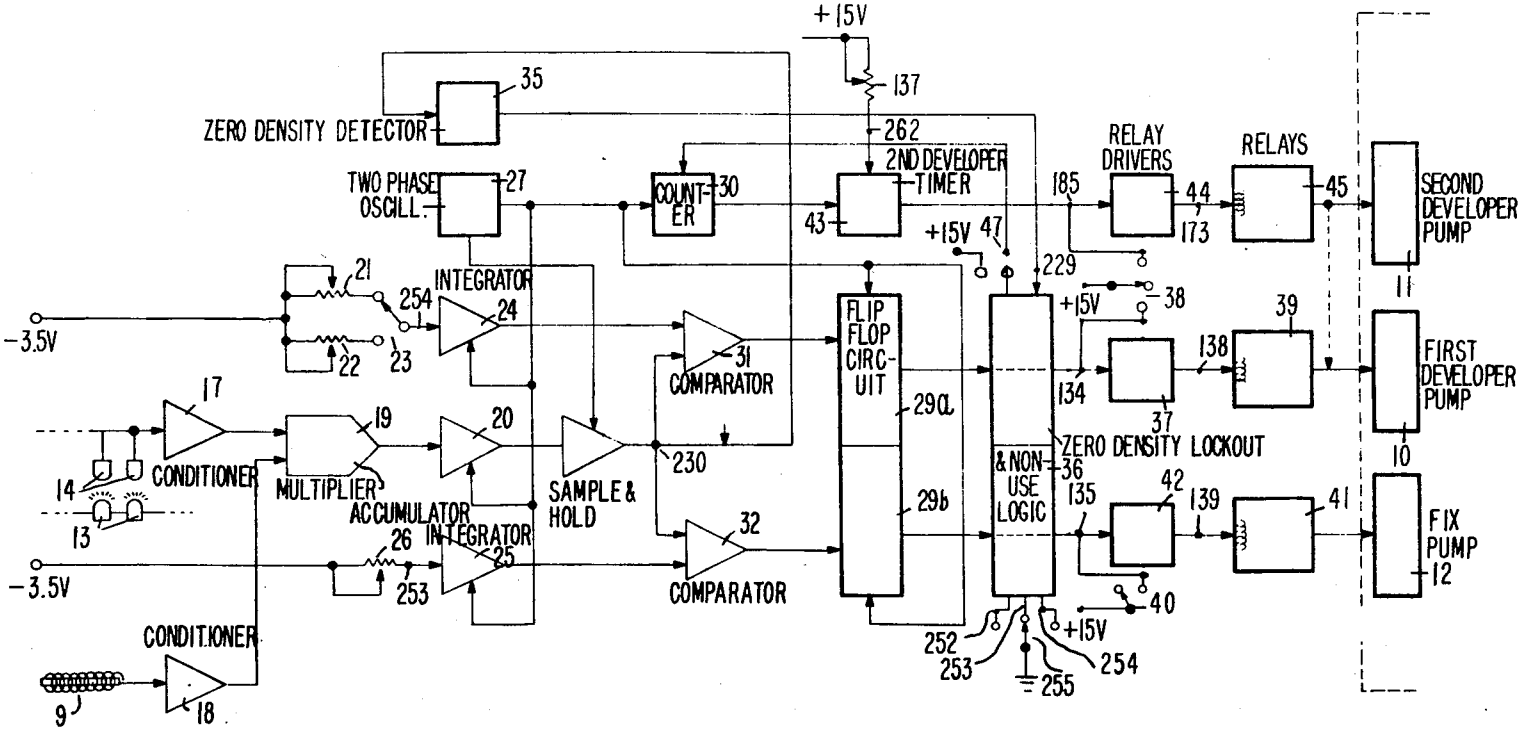
FIG. 4 is a block diagram of the control circuitry of the present invention.

Referring to FIG. 1, a film processor P is shown. A strip of film material 1 is transported by an electrical drive motor 6 and conventional conveyor means (the details of which are not shown) through a developer tank 2, fix tank 3 and a wash tank 4. This developed film 1 is then passed through a light sensitive density scanning head 5 which produces a density signal directly proportional to the image density of said developed film strip 1. Said density signal is then transmitted to control circuit assembly designated by the block 7 in FIG. 1, the components of which are shown in FIG. 4. The developed film is subsequently transported through a dryer 8 and then transported out of said processor P. A magnetic pickup 9 having a core 9*a* and a coil 9*b* is provided to produce an electrical drive signal responsive to the speed of said drive motor 6. Said drive signal transmitted to said control circuit assembly 7 which combines said drive and density signals to produce a series of control signals each of which controls a period of time a first developer pump 10, a second developer pump 11 and a fix pump 12 will be energized during regular time intervals. When said pumps 10, 11 and 12 are energized, they replenish the chemicals contained in said tanks 2 and 3 in response to the density and drive signals.

Figure 2:
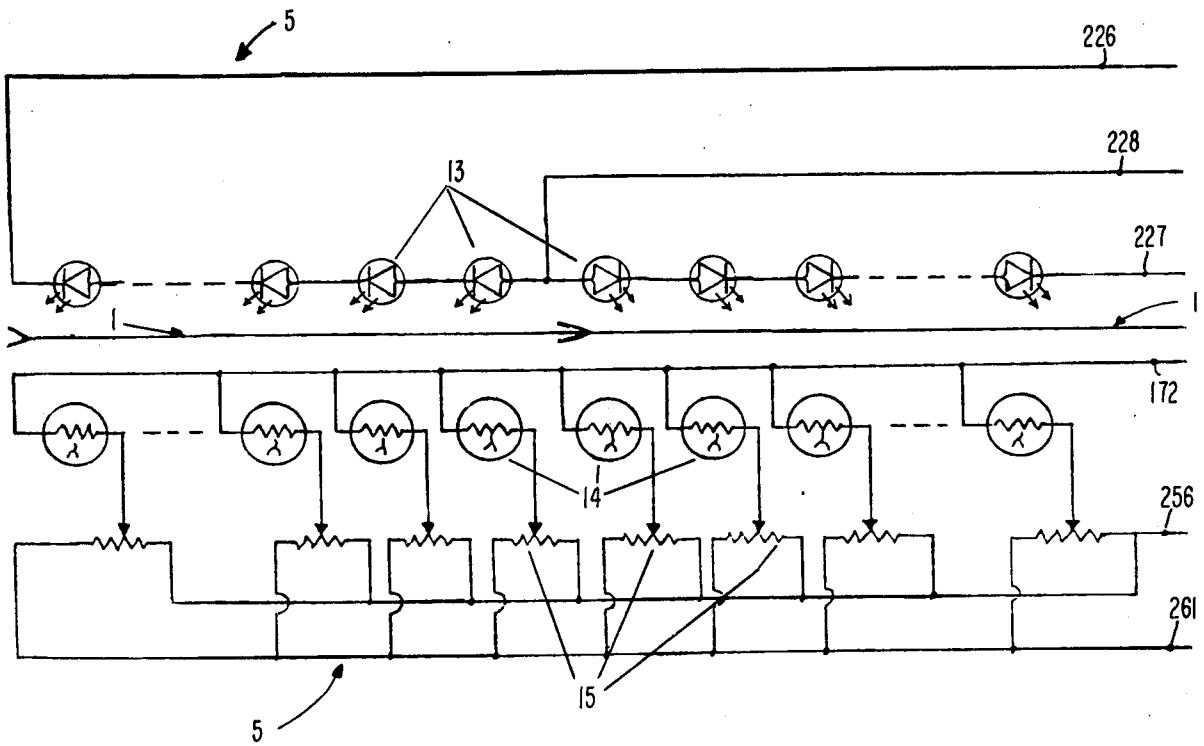
FIG. 2 shows diagrammatically the light-sensitive density scanning head for measuring the image density of the film strip passing through the film processor.

Referring to FIG. 2, said density sensing head 5 is, in the form shown, comprised of a plurality of matched pairs of light-emitting diodes 13 (LEDs) and cadmium sulfide photocells 14. The LEDs 13 and the photocells 14 are sealed respectively in liquid-tight optically transparent tubes and are fixed in closely spaced relation to each other. Balancing potentiometers 15 are provided to match the electrical characteristics of said photocells 14. Said film material strip 1 is passed between the tubes containing said LEDs 13 and photocells 14, respectively, as shown in FIG. 1. Said LEDs 13 are connected in parallel so that equal amounts of electrical current flow through each LED 13, thus ensuring uniform light emissions. LEDs are preferable over the prior art of using incandescent or fluorescent light sources in this application in that LEDs are more compact, take less power to operate, have a collimated light output, are less susceptible to vibration, emit less heat, and have a life span at least as long as the other light sources. Therefore LEDs can be positioned more closely to the film 1 with the result that less power is needed to adequately sense the image density of said film 1.

Figure 3:
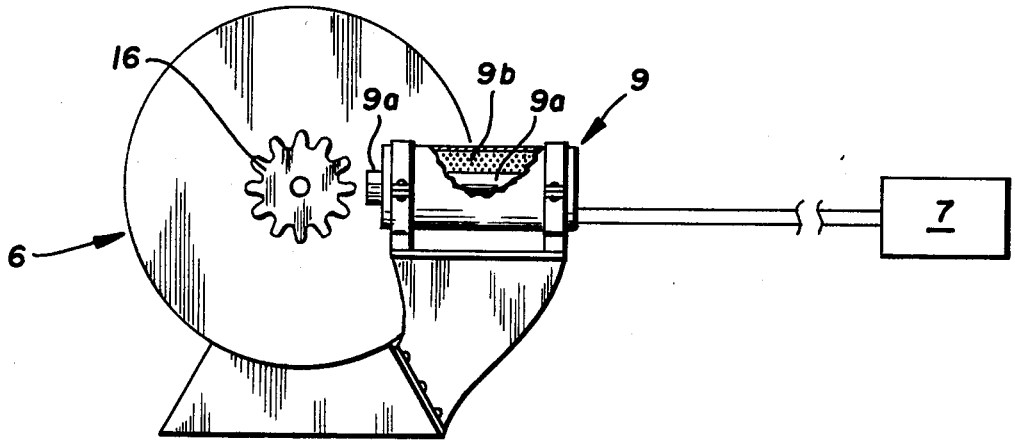
FIG. 3 shows diagrammatically magnetic means for producing the electrical drive signal responsive to the speed of travel of the film through the processor.

Referring to FIG. 3, said magnetic pickup 9 is positioned in closely spaced relation to a sprocket wheel 16 fixed to the drive shaft of drive motor 6 so that the teeth of wheel 16 will pass through the magnetic field of pickup 9 and thus produce pulse signals in winding 9*b*. The signals so produced are then transmitted to the control circuit assembly 7.

Figure 5:
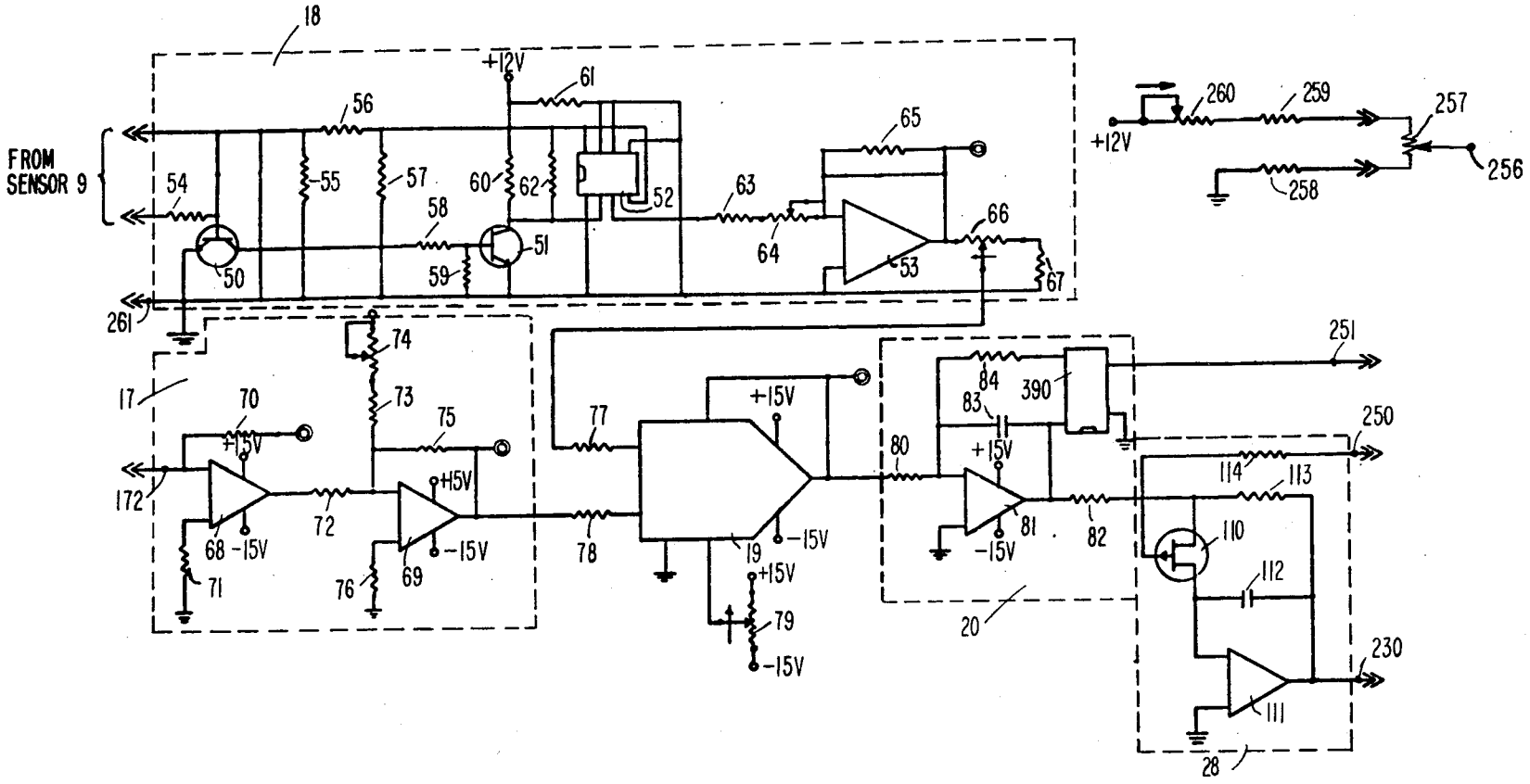
FIGS. 5, 6, and 7 are circuit diagrams respectively showing identified portions of the control circuitry of the invention.

Referring to FIG. 4, said magnetic pickup 9 is connected to a motor speed signal conditioner 18. Said conditioner 18 is shown schematically in FIG. 5, and is comprised of two npn-type transistors 50 and 51, a timer circuit 52 and an integrator circuit 53, and associated resistors and capacitors connected as shown. Said photocells 14 are connected to a density signal conditioner 17, which is comprised of an operational amplifier 68 connected as a current-to-voltage converter, and a slope inverter 69, and associated resistors and capacitors connected as shown in FIG. 5. Referring to FIG. 4, the outputs of said density signal conditioner 17 and motor speed conditioner 18 are connected to the inputs of a multiplier 19. The output of said multiplier 19 is connected to the input of an accumulator 20. Said accumulator 20 is comprised of an integrator circuit 81, a reset relay 390 and assorted resistors and capacitors connected as shown in FIG. 5.

Referring to FIG. 4, two variable timing resistors 21 and 22 have one end and the wiper arms connected to a fixed voltage source and the other end connected to one pole of a switch 23, respectively. The movable contact of switch 23 is connected to the input of a developing timing integrator 24. The input of a fix timing integrator 25 is connected to a fixed voltage source by a variable resistor 26, as shown. A two phase reset oscillator 27 has the first phase signal connected to the reset input of a sample and hold circuit 28. The second phase signal of said oscillator 27 is connected to the reset inputs of said developer timing integrator 24, said accumulator 20 and also to said fix timing integrator 25, and is connected to the first developer pump 10 and fix pump 12 start terminals of flip flop circuits 29*a* and 29*b*, respectively. Said second phase signal is also connected to the input of a counting circuit 30, known in the electronic art as a "divide by 60" counter.

Figure 6:
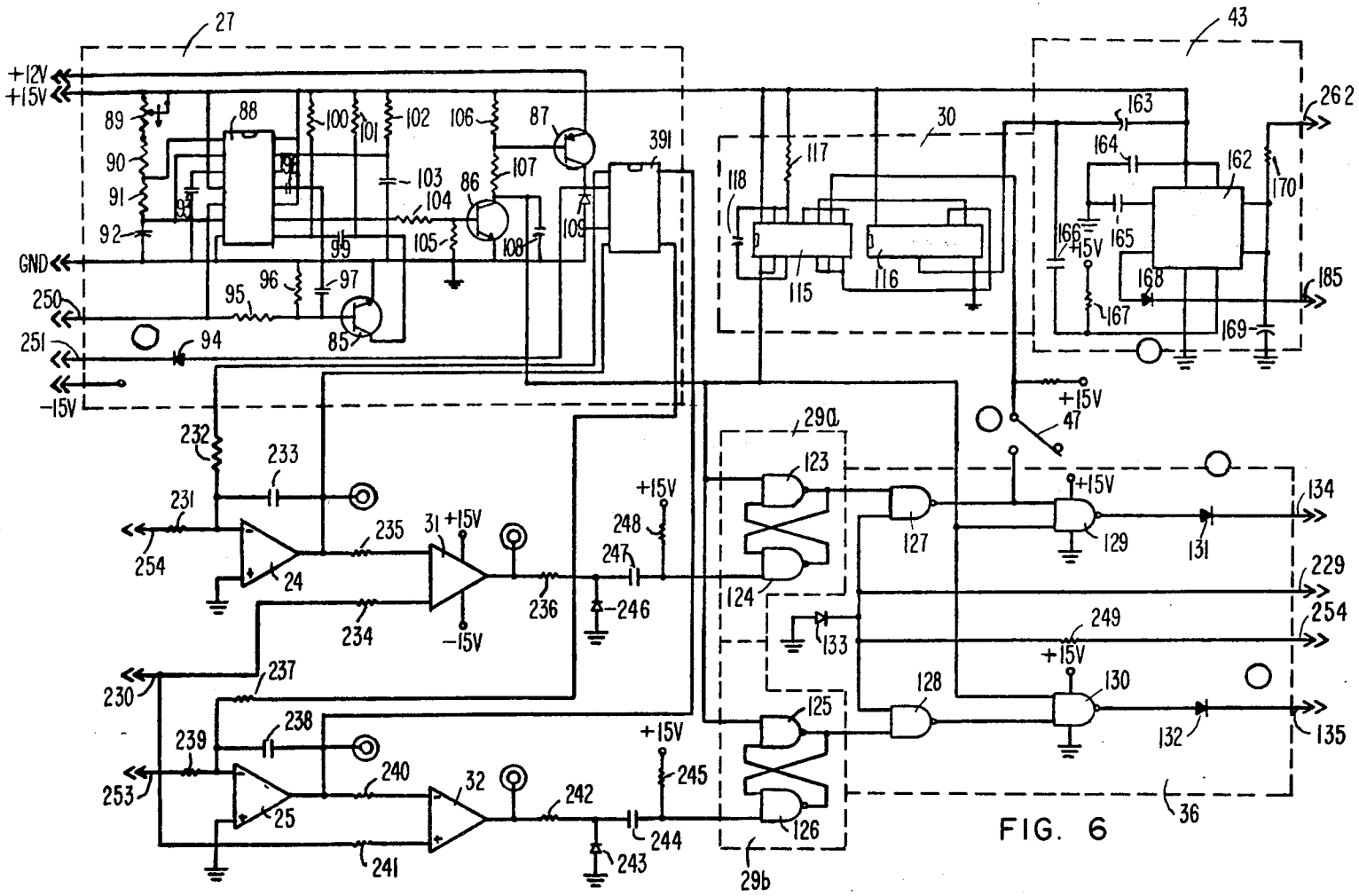

Referring to FIG. 6, said oscillator 27 is comprised of transistors 85, 86 and 87, a timing integrated circuit 88, a relay 391, and resistors, capacitors and diodes connected in the manner shown. Referring to FIG. 5, said sample and hold circuit 28 is comprised of a field-effect transistor (FET) 110, an integrator circuit 111, and resistors and capacitors connected in the manner shown. Referring to FIG. 6, said counter 30 is comprised of integrated circuit counters 115 and 116, and a resistor and capacitor connected in the manner shown.

Referring to FIG. 4, the outputs of said sample and hold circuit 28 and developer timing integrator 24 are connected to the inputs of a comparator 31, while the outputs of said sample and hold circuit 28 and fix timing integrator 25 are connected to the inputs of a comparator 32. The outputs of said comparators 31 and 32 are connected to the stop terminals corresponding to the first developer and fix pumps 10 and 12, respectively of said flip flop circuits 29*a* and 29*b*.

Figure 7:
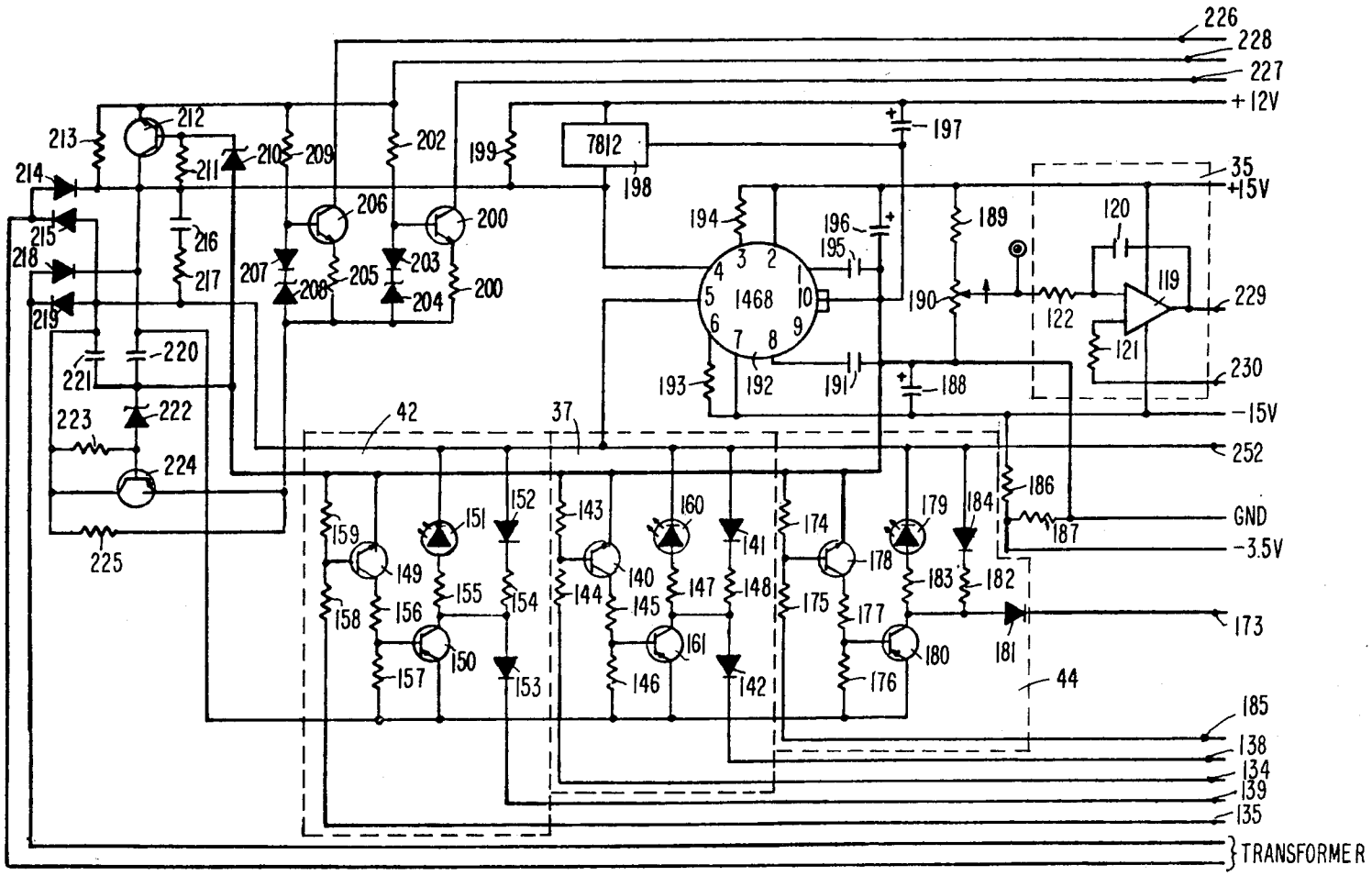

The output of said sample and hold circuit 28 is connected to a zero density detector 35 which is in turn connected to a zero density lockout and non-use logic circuit 36. Referring to FIG. 7, said zero density detector 35 is comprised of an operational amplifier 119, and resistors and capacitors connected in the manner shown. Said flip flop circuits 29*a* and 29*b* are comprised of NAND-type devices 123, 124, 125 and 126 connected as shown. Said logic circuit 36 is comprised of NAND-type devices 127, 128, 129 and 130 and diodes 131, 132 and 133 connected in the manner shown.

Referring to FIG. 4, an output of logic circuit 36 is connected to the enable input of said counter 30 through a switch 47 as shown. An output 134 of said logic circuit 36 is connected to the input of the first developer relay driver 37 and to a fixed pole of a switch 38, while an output 135 of said logic circuit 36 is connected to the input of the fix relay driver 42 and to a fixed pole of a switch 40. The movable contact of said switch 40 is connected to a fixed voltage supply. Referring to FIG. 7, said developer relay driver 37 is comprised of a LED 160, transistors 161 and 140, diodes 141 and 142 and resistors connected in the manner shown. Similaly constructed are fix relay and second developer relay drivers 42 and 44, as shown. Referring to FIG. 4, the output 138 of said first developer relay driver 37 is connected to the energizing coil of a first developer relay 39, and the output 139 of said fix relay driver 42 is connected to the energizing coil of a relay 41. Said first developer replenishing pump 10 and fix replenishing pump 12 are connected to the contacts of relays 39 and 41, respectively, in such a way that when the coils of said relays 39 and 41 are energized the respective replenishing pumps 10 and 12 are also energized. A switch 255 has its movable contact connected to ground, and has one fixed pole connected to terminal 252, which enables said replenishing pumps 10, 11 and 12 to be energized at the proper time, another fixed pole connected to terminal 253, which disables said pumps 10, 11 and 12, and another fixed pole connected to terminal 254 which enables only the second developer pump 11 to be energized at the proper time.

The output of said counter 30 is connected to a timing circuit 43. Referring to FIG. 6, said timing circuit 43 is comprised of a timing integrated circuit 162, equivalent to type 555, and resistors, capacitors and a diode connected in the manner shown. Referring to FIG. 4, a variable timing resistor 137 is connected to said timing circuit 43 in the manner shown. The output 185 of said timing circuit 43 is connected to the other fixed pole of said switch 38 and to the input of said second developer relay driver 44. The movable contact of said switch 38 is connected to a fixed voltage supply. The output 173 of said driver 44 is connected to the energizing coil of a second developer relay 45. Said second developer pump 11 is connected to the contacts of said relay 45 in such a way as to be energized whenever said coil of relay 45 is energized.

In typical operation, when the film passing between said LEDs 13 and photocells 14 has an image density of 50% (where 0% is optically transparent and 100% is opaque) an output voltage of −5 volts is produced by said density signal conditioner 17. When said drive motor 6 is operating, the teeth on said sprocket wheel 16 interrupt the magnetic field produced by said sensor 9 and produce electrical pulses in said sensor winding 9*b* which are transmitted to said motor speed conditioner 18. The frequency of said pulses is directly related to the speed of said drive motor 6. The pulses are then inverted through said transistor 50, wave shaped through transistor 51 and inverted again. Timer circuit 52 is a type 555 timer connected as a monostable one shot pulse device. Each pulse into timer circuit 52 yields a square wave pulse output of constant pulse width and amplitude, but the frequency is still directly related to the speed of said drive motor 6. This output is then integrated through said integrator 53, which produces a constant output voltage which can vary from 0 to −10 volts D.C. When said drive motor 6 is operating at 50% speed, the output voltage is at −5 volts. The outputs of said conditioners 17 and 18 are combined by said multiplier 19, which produces a signal equal to the multiple of the conditioner signals, divided by a factor of 10. Therefore, when the conditioner signals are at −5 volts, the output voltage of said multiplier 19 is at +2.5 volts. The output of said multiplier 19 is applied to the input of said accumulator 20, where it is integrated for a set time period of 30 seconds.

Said reset oscillator 27 is a two phase oscillator circuit of a type well known in the art, which produces two separate timed signals. Each of these two signals consists of a 20 millisecond pulse every 30 seconds, said signals being so timed that the phase two pulse occurs immediately after the phase one pulse occurs.

When the phase one signal pulse is applied to said sample and hold circuit 28, said circuit 28 acquires the output signal of said accumulator 20 and the output signal of said circuit 28 will be held at the acquired signal level until the next phase is applied 30 seconds later.

Said phase two signal pulse is then applied to the reset inputs of timing integrators 24 and 25 and said accumulator 20 which sets the output signal of said accumulator 20 to 0 volts and to the first developer and the fix start inputs of said flip flop circuit 29. When said phase two signal is applied to the first developer start input of said circuit **29*a*, a signal is produced and applied to the first developer input of the logic circuit 36. Said logic circuit 36 then applies a signal to the input of relay driver 37, which in turn energizes relay 39. Said relay 39 energizes the first developer replenishment pump 10. A similar operation is performed to energize said fix pump 12. The phase two signal is applied to the fix start input of circuit 29*b*, and said circuit 29 then generates a signal which is applied to the fix input of logic circuit 36. Said logic circuit 36 then applies a signal to the input of fix relay driver 42 which in turn energizes fix relay 41. Said relay 41 energizes said fix pump 12**.

The accumulator 20, after the application of said phase two pulse, again starts to integrate the output from multiplier 19 over said 30 second time period. Said timing integrators 24 and 25, after the application of said phase two pulse, initiate integration of the current preset by the variable timing resistors 21 or 22, depending on the position of said switch 23, and variable timing resistor 26. More pre-set currents may be made available to said integrators 24 and 25 by the addition of more variable resistors in a manner similar to said resistors 21, 22 and 26. The outputs of said integrators 24 and 25 are applied to inputs of comparators 31 and 32 respectively.

The output of said sample and hold circuit 28 is applied to the other input of said comparators 31 and 32. When the output voltage level of developer timing integrator 24 exceeds the voltage level of the output of the sample and hold circuit 28, a signal is generated by said comparator 31 and applied to a stop input of flip flop circuit **29*a* which then de-energizes said first developer replenishing pump 37. When the output voltage level of said fix timing integrator 25 exceeds the voltage level of the output of said sample and hold circuit 28, said comparator 32 generates a signal which is applied to a stop input of flip flop circuit 29*b*, which then de-energizes said fix replenishing pump 34. When there is 50% density and said drive motor 6 is operating at half speed, said pumps 10 and 12** are energized for 7½ seconds out of each fixed 30 second time period.

The output of the sample and hold circuit 28 is also applied to the input of a zero density detector 35. When a zero density condition is detected, or when there is no film passing through said developer or when the speed of said motor 6 is zero (the last two conditions commonly referred to as the non-use condition), said detector 35 applies a signal to the zero density lockout and non-use logic circuit 36 terminal 229. This has the result of deenergizing the first developer and fix pumps 10 and 12 20 milliseconds after energizing said pump. With manual switch 47 in the closed position, said logic circuit 36 will generate an enable signal and apply it to said counter 30 thus advancing said counter one increment whenever a zero density condition is detected, or when a non-use condition (when the signal output of said motor speed signal conditioner 18 is zero) is detected. When switch 47 is in the elapsed (open) position, said counter 30 will be advanced one increment every 30 seconds with each phase two reset pulse. When said counter 30 has been incremented 60 times, a signal is generated by said counter 30 and is applied to the second developer replenishing timer 43, which energizes relay 45 through relay driver 44, said relay 45 energizing the second developer replenishing pump 11 for a set period of time determined by the variable timer control resistor 137.

Said relay drivers 37, 42 and 44 may also be energized manually by use of manual switches 38 and 40 to energize the respective pumps 10, 11 and 12 as long as said switches are in the appropriate operating position.

It will of course be understood that various changes may be made in the form, details, arrangement and proportions of the parts without departing from the scope of this invention as set forth in the appended claims.

What is claimed is:

1. An automatic replenisher system for photographic film processors of the type having a liquid confining processing tank and a conveyor system defining a film path extending through the tank and therebeyond, said system comprising, a normally deenergized replenisher pump for supplying replenishing liquid to the tank, means for automatically periodically energizing the pump at predetermined intervals regardless of the density of the film processed in said tank, light-sensitive film density scanning means positioned in the film path beyond the tank for measuring the image density of the processed film and for producing an electrical control signal responsive to the density of said processed film, comparator circuit means receiving said signal for comparing the same to a reference signal and de-energizing said replenisher pump as a function of the comparing, whereby the time duration between energizing and de-energizing is a function of measured image density of the processed film.

2. The automatic replenisher system recited in claim 1 further comprising, means for deriving an electrical signal responsive to the speed of travel of exposed film through said film processor, means for combining said density scanning and film speed electrical signals into a combined electrical control signal, means for controlling the duration said replenishment pump is energized in response to said combined electrical control signal.

3. The automatic replenisher system recited in claim 2 wherein said means for deriving an electrical signal responsive to the speed of travel of said exposed film through the film processor comprises, a drive motor for driving said film through the processor, a magnetic pickup device associated with the drive motor to produce electrical signal pulses, the frequency of which is proportional to the speed of said drive motor, and means to transform said signal pulses into an analog signal whose amplitude is proportional to the frequency of said electrical signal pulses by said magnetic pickup device.

4. The automatic replenisher system recited in claim 1 further comprising, means for detecting a zero density condition signal from said light-sensitive density scanning means, and means for momentarily energizing said replenishment pump at said predetermined time intervals when said zero density signal is detected.

5. The automatic replenisher system recited in claim 1 further comprising, means for detecting a zero density condition signal from said light-sensitive density scanning means, means for detecting a non-use condition in said film processor, and means for momentarily energizing said replenishment pump at said predetermined time intervals when said zero density condition signal or said non-use condition are present.

6. The automatic replenisher system recited in claim 1 wherein said light-sensitive density scanning means for measuring the image density of said film and for producing an electrical signal responsive thereto comprises, a plurality of paired light emitting diodes and light-sensitive receiving elements in fixed relation to each other, and means for combining the electrical signals from said light-sensitive receiving elements and for amplifying the resulting electrical signal to produce said electrical signal responsive to the optical density of said developed film.

7. The automatic replenisher system recited in claim 1 wherein said means for periodically energizing said replenishment pump at predetermined time intervals comprising:

a two phase oscillator circuit for producing a first phase signal and a second phase signal, said phase signals being in fixed consecutive relation to each other, and the frequency of said phase signals determining said predetermined time intervals, and means for applying said second phase signal to energize said replenishment pump.

8. The automatic replenisher system recited in claim 7 further comprising, an ancillary replenishment pump for supplying a replenishing fluid to said film processor, counting means which is advanced by the application of said second phase signal, means which produce a timing signal each time said counting means is advanced a predetermined number of times, and timing means which energizes said ancillary replenishment pump for a predetermined time interval when said timing signal is applied to said timing means.

9. An automatic replenisher system for photographic film processors of the type having a liquid confining processing tank and a conveyor system defining a film path extending through the tank and therebeyond, said system comprising, a normally de-energized replenisher pump for supplying replenishing liquid to the tank, means for automatically periodically energizing the pump at predetermined intervals regardless of the density of the film processed in said tank, light-sensitive film density scanning means positioned in the film path beyond the tank for measuring the image density of the processed film and for producing an electrical control signal responsive to the density of said processed film, comparator circuit means receiving said signal for comparing the same to a reference signal and de-energizing said replenisher pump, as a function of the comparing, whereby the time duration between energizing and deenergizing is a function of measured image density of the processed film, said means for automatically periodically energizing the pump at predetermined time intervals comprising:

a two phase oscillator circuit for producing a first phase signal and second phase signal, said phase signals being in fixed consecutive relation to each other, and the frequency of said phase signals determining said predetermined time intervals, means for supplying said second phase signal to energize said replenishment pump, said comparator circuit means comprising:

an accumulator which accumulates said electrical control signal and produces an output signal, a sample and hold circuit which acquires and holds the output signal of said accumulator when said first phase signal is applied to said sample and hold circuit, a timing integrator circuit which produces a present reference current and integrates said reference current to produce an output reference voltage, a comparator circuit which compares the electrical control signal to the output reference of said timing integrator circuit, and means to deenergize said replenishment pump when the output voltage level of said timing integrator circuit corresponding to said replenishment pump exceeds the voltage level of said electrical control signal.

10. The automatic replenisher system recited in claim 9 wherein said timing integrator circuit comprises, a current integrator circuit which integrates a pre-set reference current, and means for selecting, among a plurality of pre-set reference currents, the reference currents to be integrated.

11. The automatic replenisher system recited in claim 10 wherein said means for selecting, among a plurality of pre-set reference currents, comprises, a fixed independent direct current voltage source, a plurality of variable resistors which have one end and the wiper arms connected to said voltage source, and a switch which has each fixed pole connected to the other end of one of said variable resistors and the movable contact of said switch connected to the input of said current integrator circuit.

* * * * *